US006498101B1

(12) United States Patent
Wang

(10) Patent No.: US 6,498,101 B1
(45) Date of Patent: Dec. 24, 2002

(54) PLANARIZING PADS, PLANARIZING MACHINES AND METHODS FOR MAKING AND USING PLANARIZING PADS IN MECHANICAL AND CHEMICAL-MECHANICAL PLANARIZATION OF MICROELECTRONIC DEVICE SUBSTRATE ASSEMBLIES

(75) Inventor: Dapeng Wang, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/514,578

(22) Filed: Feb. 28, 2000

(51) Int. Cl.[7] ..... H01L 21/00

(52) U.S. Cl. ..... 438/691; 156/345; 216/38; 216/88; 216/89; 216/91; 438/692; 438/693; 438/745

(58) Field of Search ..... 156/345 LP; 216/38, 216/88, 89, 91; 438/690, 691, 692, 693, 745

(56) References Cited

U.S. PATENT DOCUMENTS

| | | | | |
|---|---|---|---|---|
| 5,020,283 | A | | 6/1991 | Tuttle |
| 5,196,353 | A | | 3/1993 | Sandhu et al. |
| 5,222,329 | A | | 6/1993 | Yu |
| 5,232,875 | A | | 8/1993 | Tuttle et al. |
| 5,240,552 | A | | 8/1993 | Yu et al. |
| 5,244,534 | A | | 9/1993 | Yu et al. |
| 5,314,843 | A | | 5/1994 | Yu et al. |
| 5,449,314 | A | | 9/1995 | Meikle et al. |
| 5,486,129 | A | | 1/1996 | Sandhu et al. |
| 5,514,245 | A | | 5/1996 | Doan et al. |
| 5,534,106 | A | * | 7/1996 | Cote et al. ..... 438/693 |
| 5,540,810 | A | | 7/1996 | Sandhu et al. |
| 5,609,718 | A | | 3/1997 | Meikle |
| 5,616,069 | A | | 4/1997 | Walker et al. |
| 5,618,381 | A | | 4/1997 | Doan et al. |
| 5,624,303 | A | | 4/1997 | Robinson |
| 5,643,048 | A | | 7/1997 | Iyer |
| 5,645,682 | A | | 7/1997 | Skrovan |
| 5,650,619 | A | | 7/1997 | Hudson |
| 5,655,951 | A | | 8/1997 | Meikle et al. |
| 5,658,190 | A | | 8/1997 | Wright et al. |
| 5,663,797 | A | | 9/1997 | Sandhu |
| 5,679,065 | A | | 10/1997 | Henderson |
| 5,681,423 | A | | 10/1997 | Sandhu et al. |
| 5,690,540 | A | | 11/1997 | Elliott et al. |

(List continued on next page.)

*Primary Examiner*—William A. Powell
(74) *Attorney, Agent, or Firm*—Perkins Coie LLP

(57) ABSTRACT

Planarizing pads and methods for making or using planarizing pads to polish or planarize semiconductor wafers, field emission displays, or other microelectronic substrates and substrate assemblies. In one embodiment, the planarizing pad comprises a compressible body and a plurality of discrete contact elements. The compressible body can comprise a base having a backside facing a support surface of a table and a front side facing away from the support surface. The contact elements can comprise raised sections of a single layer or separate plates. The contact elements have a bottom surface attached to the front side of the base and a top surface configured to contact a microelectronic substrate facing away from the base. The compressible body has a first hardness and the contact elements have a second hardness greater than the first hardness, and/or the body has a first compressibility and the contact elements have a second compressibility less than the first compressibility. The compressible body can be a compressible foam (e.g., foamed polyurethane), and the contact elements can be a hard, rigid material (e.g., polycarbonate, resin, polyester or high density polyurethane). In operation, the contact elements can move independently from one another in a direction transverse to the substrate.

91 Claims, 7 Drawing Sheets

U.S. PATENT DOCUMENTS 5,692,950 A 12/1997 Rutherford et al.
5,698,455 A 12/1997 Meikle et al.
5,702,292 A 12/1997 Brunelli et al.
5,725,417 A 3/1998 Robinson
5,736,427 A 4/1998 Henderson
5,738,567 A 4/1998 Manzonie et al.
5,747,386 A 5/1998 Moore
5,779,522 A 7/1998 Walker et al.
5,782,675 A 7/1998 Southwick
5,792,709 A 8/1998 Robinson et al.
5,795,218 A 8/1998 Doan et al.
5,795,495 A 8/1998 Meikle
5,798,302 A 8/1998 Hudson et al.
5,801,066 A 9/1998 Meikle
5,823,855 A 10/1998 Robinson
5,830,806 A 11/1998 Hudson et al.
5,846,336 A 12/1998 Skrovan
5,855,804 A 1/1999 Walker
5,868,896 A 2/1999 Robinson et al.
5,871,392 A 2/1999 Meikle et al.
5,879,222 A 3/1999 Robinson
5,879,226 A 3/1999 Robinson
5,882,248 A 3/1999 Wright et al.
5,893,754 A 4/1999 Robinson et al.
5,894,852 A 4/1999 Gonzales et al.
5,899,745 A * 5/1999 Kim et al. ..... 438/692
5,910,043 A 6/1999 Manzonie et al.
5,910,846 A 6/1999 Sandhu
5,934,980 A 8/1999 Koos et al.
5,938,801 A 8/1999 Robinson
5,954,912 A 9/1999 Moore
5,972,792 A 10/1999 Hudson
5,976,000 A 11/1999 Hudson
5,980,363 A 11/1999 Meikle et al.
5,981,396 A 11/1999 Robinson et al.
5,989,470 A 11/1999 Doan et al.
5,994,224 A 11/1999 Sandhu et al.
5,997,384 A 12/1999 Blalock
6,036,586 A 3/2000 Ward
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,083,085 A 7/2000 Lankford
6,106,351 A 8/2000 Raina et al.
6,108,092 A 8/2000 Sandhu
6,110,820 A 8/2000 Sandhu et al.
6,114,706 A 9/2000 Meikle et al.
6,120,354 A 9/2000 Koos et al.
6,124,207 A 9/2000 Robinson et al.
6,139,402 A 10/2000 Moore
6,143,123 A 11/2000 Robinson et al.
6,186,870 B1 2/2001 Wright et al.
6,187,681 B1 2/2001 Moore
6,190,494 B1 2/2001 Dow
6,191,037 B1 2/2001 Robinson et al.
6,191,864 B1 2/2001 Sandhu
6,200,901 B1 3/2001 Hudson et al.
6,203,407 B1 3/2001 Robinson
6,203,413 B1 3/2001 Skrovan
6,206,754 B1 3/2001 Moore
6,206,759 B1 3/2001 Agarwal et al.
6,206,769 B1 3/2001 Walker
6,210,257 B1 4/2001 Carlson
6,213,845 B1 4/2001 Elledge
6,227,955 B1 5/2001 Custer et al.
6,234,877 B1 5/2001 Koos et al.
6,234,878 B1 5/2001 Moore
6,238,270 B1 5/2001 Robinson
6,238,273 B1 5/2001 Southwick
6,244,944 B1 6/2001 Elledge
6,250,994 B1 6/2001 Chopra et al.
6,261,163 B1 7/2001 Walker et al.
6,271,139 B1 8/2001 Alwan et al.
6,273,101 B1 8/2001 Gonzales et al.
6,273,800 B1 8/2001 Walker et al.
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 10/2001 Moore
6,306,014 B1 10/2001 Walker et al.
6,309,282 B1 10/2001 Wright et al.
6,312,558 B2 11/2001 Moore
6,319,420 B1 11/2001 Dow
6,323,046 B1 11/2001 Agarwal
6,325,702 B2 12/2001 Robinson
6,328,632 B1 12/2001 Chopra
6,331,135 B1 12/2001 Sabde et al.
6,331,139 B2 12/2001 Walker et al.
6,331,488 B1 12/2001 Doan et al.
6,350,180 B2 2/2002 Southwick
6,350,691 B1 2/2002 Lankford
6,352,466 B1 3/2002 Moore
6,352,470 B2 3/2002 Elledge

* cited by examiner

PLANARIZING PADS, PLANARIZING MACHINES AND METHODS FOR MAKING AND USING PLANARIZING PADS IN MECHANICAL AND CHEMICAL-MECHANICAL PLANARIZATION OF MICROELECTRONIC DEVICE SUBSTRATE ASSEMBLIES

TECHNICAL FIELD

The present invention relates to planarizing pads and methods for making and using planarizing pads in mechanical and chemical-mechanical planarization of semiconductor wafers, field emission displays, and other microelectronic device substrate assemblies.

BACKGROUND OF THE INVENTION

Mechanical and chemical-mechanical polishing processes (collectively "CMP") remove material from the surface of microelectronic substrates in the production of microelectronic devices and other products. FIG. 1 schematically illustrates a rotary CMP machine 10 with a platen 20, a wafer carrier 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The wafer carrier 30 has a lower surface 32 to which a wafer 12 may be attached, or the wafer 12 may be attached to a resilient pad 34 under the lower surface 32. The wafer carrier 30 may be a weighted, free-floating wafer carrier, or an actuator assembly 36 may be attached to the wafer carrier to impart axial and/or rotational motion to the wafer 12 (indicated by arrows I and J, respectively).

The planarizing pad 40 and the planarizing solution 44 defame a planarizing medium that mechanically and/or chemically-mechanically removes material from the surface of the substrate 12. The planarizing pad 40 can be a fixed-abrasive planarizing pad having abrasive particles fixedly bonded to a suspension material. In fixed-abrasive applications, the planarizing solution is generally a "clean solution" without abrasive particles. In other applications, the planarizing pad 40 can be a non-abrasive pad composed of a polymeric material (e.g., polyurethane, polycarbonate or polyester), felt, resin or other suitable materials. The planarizing solutions 44 used with the non-abrasive planarizing pads are typically CMP slurries with abrasive particles and chemicals.

To planarize the wafer 12 with the CMP machine 10, the wafer carrier 30 presses the wafer 12 face-downward against the planarizing pad 40. More specifically, the wafer carrier 30 generally presses the wafer 12 against the planarizing liquid 44 on a planarizing surface 42 of the planarizing pad 40, and the platen 20 and/or the wafer carrier 30 moves to rub the wafer 12 against the planarizing surface 42. As the wafer 12 rubs against the planarizing surface 42, the planarizing medium removes material from the face of the wafer 12.

CMP processes should consistently and accurately produce a uniformly planar surface on the substrate to enable precise fabrication of circuits and photo-patterns. During the fabrication of transistors, contacts, interconnects and other features, many substrates develop large "step heights" that create highly topographic surfaces. Such topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices.

One problem with many CMP processes is that the surface of the wafer may not be uniformly planar because the rate at which material is removed from the wafer (the "polishing rate") may vary from one area of the wafer to another. The characteristics of the planarizing pad generally influence the variance of the polishing rate globally across the substrate surface and also at a smaller scale across the individual dies ("chips") on the substrate. For example, hard or incompressible planarizing pads quickly remove high points on the substrate to produce a good planarity across the individual dies, but hard pads generally produce large variances in the polishing rate in a band about 10 mm inward from the perimeter edge ("edge effects"). Hard pads may thus produce poor global planarity on a substrate. Soft or compressible planarizing pads, on the other hand, generally produce good global planarity because they mitigate edge effects, but soft pads may follow the topography between dies and periphery areas such that they produce "doming" over the individual dies. Soft pads accordingly produce poor planarity at a die level on a substrate. Therefore, neither hard nor soft pads produce good planarity at a global level without producing doming over the dies.

To resolve the problems associated with hard and soft planarizing pads, several conventional pads have a combination of soft and hard materials including a soft base layer and an inflexible, hard planarizing layer on the base layer. The planarizing layer contacts the surface of the substrate during a planarizing cycle and the base layer distributes differences in pressure between the pad and the substrate. Although such two-layer pads provide an improvement over single-layer pads, the hard planarizing layer still produces edge effects on the substrates in many applications. This drawback is expected to become even more prominent for CMP of twelve-inch wafers instead of eight-inch wafers.

SUMMARY OF THE INVENTION

The present invention relates to planarizing pads and methods for making or using planarizing pads to polish or planarize semiconductor wafers, field emission displays, or other microelectronic substrates and substrate assemblies. In one embodiment, the planarizing pad comprises a compressible body and a plurality of discrete contact elements. The compressible body can comprise a base having a backside facing a support surface of a table and a front side facing away from the support surface. The contact elements can comprise raised sections of a single layer or separate plates. The contact elements have a bottom surface attached to the front side of the base and a top surface facing away from the base. The compressible body has a first hardness and the contact elements have a second hardness greater than the first hardness, and/or the compressible body has a first compressibility and the contact elements have a second compressibility less than the first compressibility. The compressible body can be a compressible foam (e.g., foamed polyurethane), and the contact elements can be a hard, rigid material (e.g., polycarbonate, resin, polyester, or high density polyurethane). In operation, the contact elements can move independently from one another in a direction transverse to the substrate.

DETAILED DESCRIPTION

The present invention is directed to planarizing pads, planarizing machines, and methods for making and using planarizing pads related to mechanical and/or chemical-mechanical planarization of microelectronic substrates and substrate assemblies. The terms "substrate" and "substrate assembly" are used inter-changeably herein to mean any type of microelectronic wafer at any stage of fabricating microelectronic devices. Many specific details of the invention are described below with reference to rotary planarizing applications to provide a thorough understanding of such embodiments. The present invention, however, can be practiced using web-format machines. A person skilled in the art will thus understand that the invention may have additional embodiments, or that the invention may be practiced without several of the details described below.

Figure 1:
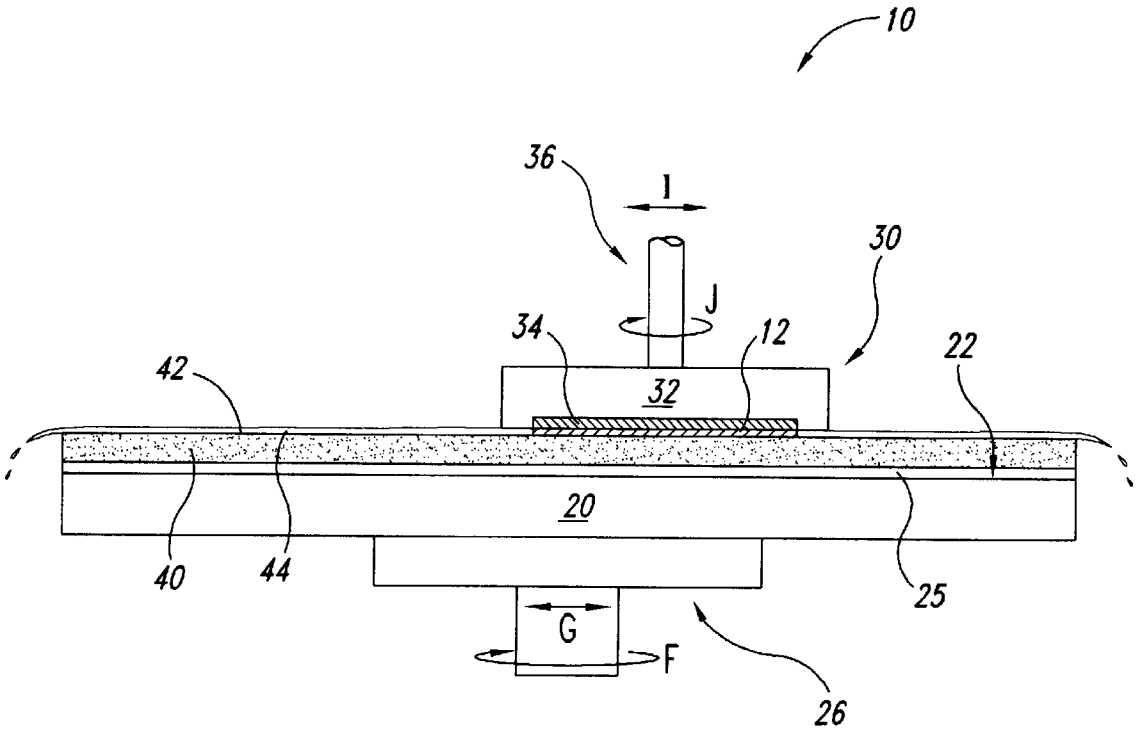
Fig. 1 (Prior Art)
FIG. 1 is a partial schematic cross-sectional view of a rotary planarizing machine and a fixed-abrasive planarizing pad in accordance with the prior art.
Figure 2A:
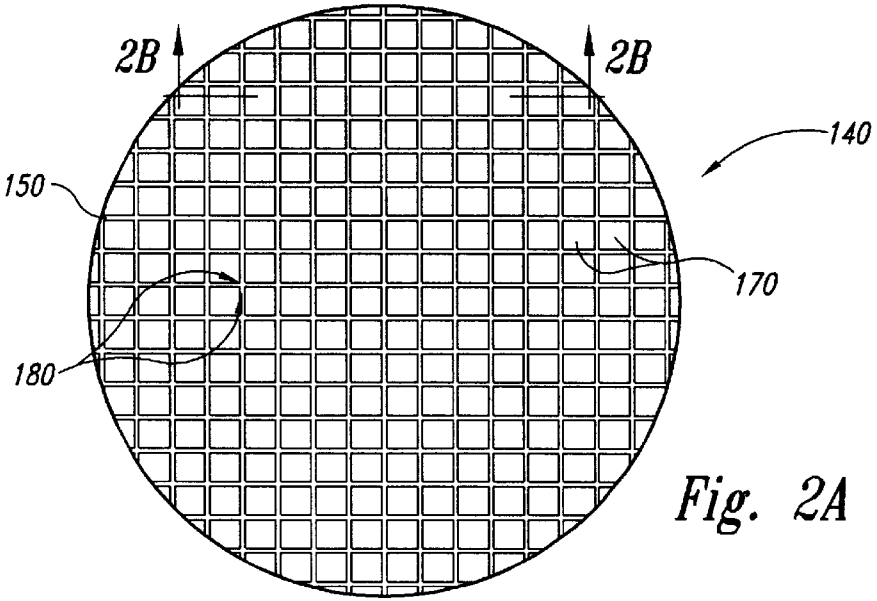
FIG. 2A is a top plan view of a planarizing pad in accordance with an embodiment of the invention.
Figure 2B:
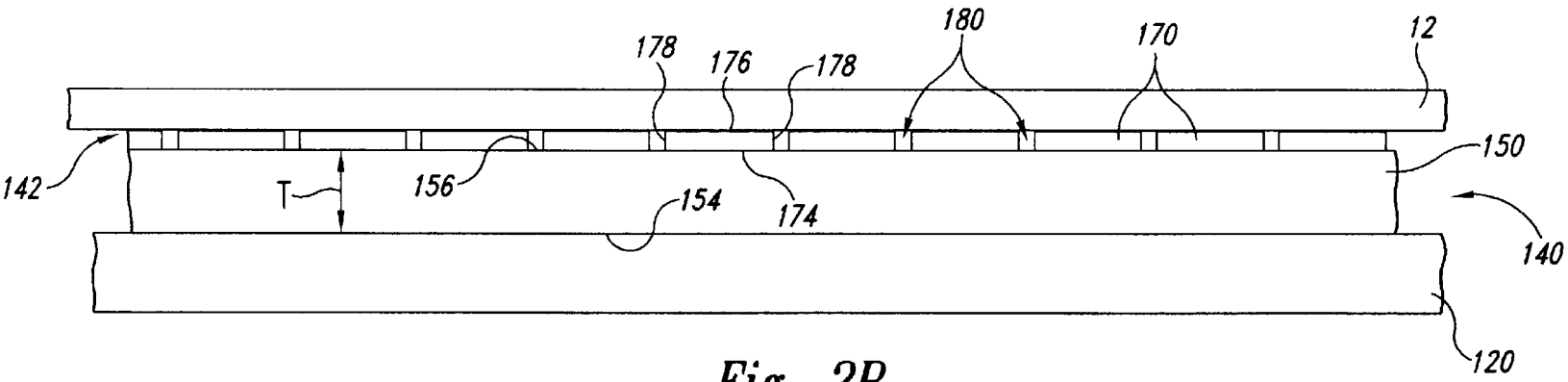
FIG. 2B is a partial cross-sectional view of the planarizing pad of FIG. 2A taken along line 2B—2B.

FIG. 2A is a planform view and FIG. 2B is a partial cross-sectional view of a planarizing pad 140 in accordance with one embodiment of the invention. In this embodiment, the planarizing pad 140 includes a compressible body or base 150 having a first hardness or first compressibility, and a plurality of contact elements 170 attached to the base 150. The contact elements 170 have a second hardness greater than the first hardness and/or a second compressibility less than the first compressibility. As explained in more detail below, the contact elements 170 can be separate plates that are completely separate from one another, or they can be connected by a thin, flexible web. In either case, the contact elements 170 are discrete elements in the sense that they can move independently from one another in a direction transverse to the substrate assembly 12 (indicated by arrow T in FIG. 2B). The term "transverse," as used herein, means any non-parallel orientation or movement and is not limited to meaning perpendicular.

Referring to FIG. 2B, the base 150 can be a flat compressible pad having a back side 154 and a front side 156. The back side 154 is generally attached to a table 120 of a web-format or rotary planarizing machine or a sub-pad (not shown) on the table 120. The base 150, for example, can be a compressible body of foam, soft felt, sponge or other suitably compressible materials. The base 150 is preferably a foamed polyurethane that is highly compressible, has a low hardness, and a rapid elastic deformation. The base 150, for example, preferably has a compressibility of approximately 12–16 percent and a hardness of approximately 55–65 Shore A. Suitable materials for the base include the materials of the Suba IV and the Suba 500 planarizing pads manufactured by Rodel Corporation of Newark, Del.

The contact elements 170 are preferably hard plates attached to the base 150. Each contact element 170 can be a separate plate having a bottom surface 174, a top surface 176, and side surfaces 178. The bottom surface 174 is attached to the front side 156 of the base 150, and the top surfaces 176 collectively defame a planarizing surface 142 for contacting the substrate 12. In the embodiment of the planarizing pad 140 shown in FIGS. 2A and 2B, the sides 178 of adjacent contact elements are spaced apart by channels or gaps 180.

The contact elements 170 can have a surface area of 10–300 percent of the die size, and more preferably 75–150 percent of the die size. For example, when the dies on the substrate 12 have an area of approximately 100 $mm^2$, the contact elements 170 preferably have a surface area of approximately 75–150 $mm^2$. Additionally, the channels 180 can have a width of 0.5–5.0 $mm^2$, and more preferably approximately 1.4–1.7 mm. As explained in more detail below, the contact elements 170 and the channels 180 can have different sizes and shapes according to the particular size and configuration of the individual dies on the substrate 12.

The contact elements 170 are preferably significantly harder and less compressible than the base 150. The contact elements 170 can include polycarbonates (Lexan®), polyesters (Mylar®), high density polyurethanes, resins and other hard materials. In a preferred embodiment, the contact elements 170 have a compressibility less than five percent and a Shore D hardness greater than 50.

Figure 3A:
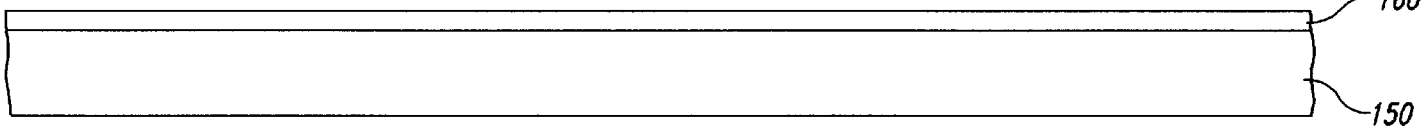
FIGS. 3A and 3B are partial cross-sectional views illustrating a method for forming a planarizing pad in accordance with an embodiment of the invention.
Figure 3B:
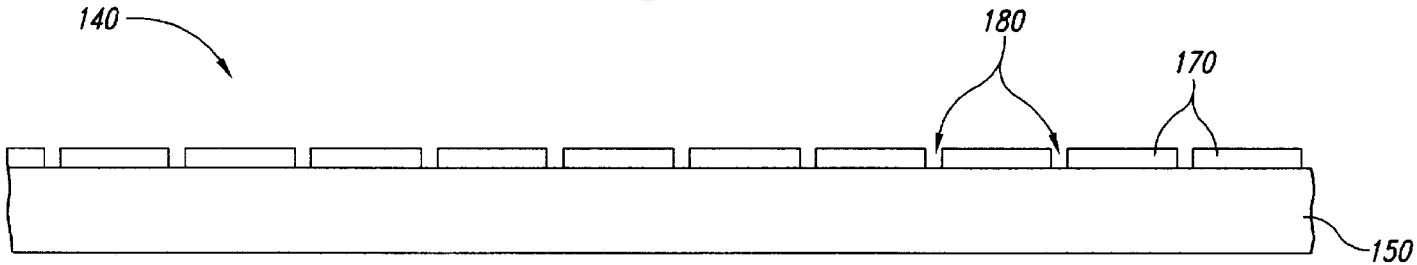

FIGS. 3A and 3B are partial cross-sectional views illustrating a method for fabricating the planarizing pad 140 of FIGS. 2A and 2B. Referring to FIG. 3A, a base layer of compressible material defining the base 150 is covered with a contact layer 160 of a hard material from which the contact elements 170 are formed. Referring to FIG. 3B, the channels 180 are then cut or etched into the contact layer 160 to form the contact elements 170. The channels 180 can be cut by a high precision machine tool, a laser, or an etching process known to persons skilled in the art. For the rectilinear grid pattern shown in FIG. 2A, it is generally preferable to cut the grooves 180 with a high precision machine tool or laser. For other non-rectilinear patterns, it is generally preferable to cut the grooves with an etching process or a laser.

Figure 4:
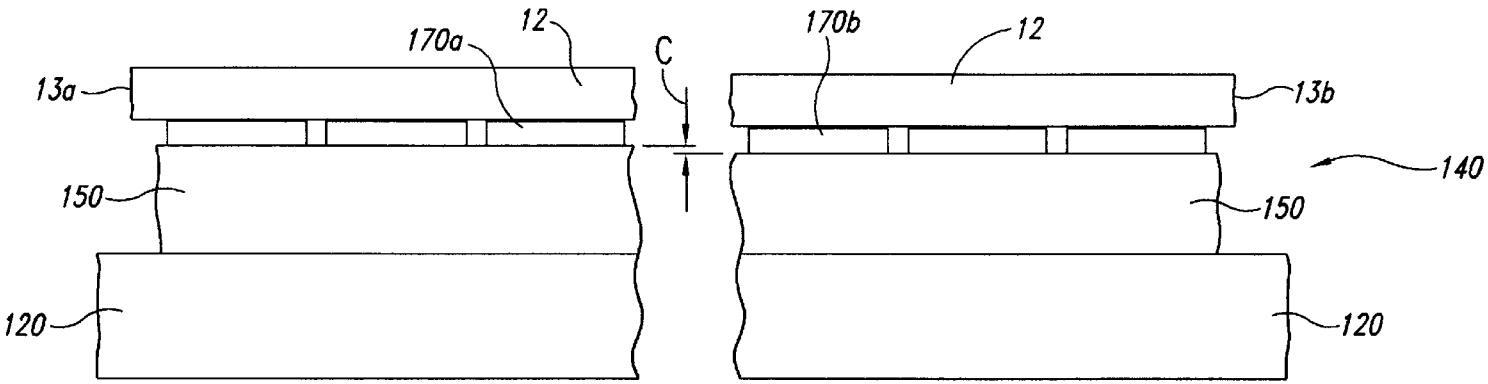
FIG. 4 is a partial cross-sectional view of a planarizing machine with a planarizing pad illustrating a method of planarizing a microelectronic substrate in accordance with an embodiment of the invention.

FIG. 4 is a partial cross-sectional view illustrating an embodiment of a method for planarizing the substrate 12 on the planarizing pad 140. In this embodiment, a planarizing solution (not shown) is disposed on the planarizing pad 140 and the substrate assembly 12 is pressed against the contact elements 170 at a desired downforce. The substrate assembly 12 and/or the planarizing pad 150 also move in a planarizing plane to rub the substrate 12 against the top surfaces 176 of the contact elements 170. The planarizing solution and the contact elements 170 act together to remove material from the substrate 12.

During a planarizing cycle, the pressure between a first portion 13*a* of the substrate 12 contacting a first contact element 170*a* may be less than the pressure between a second portion 13*b* of substrate 12 contacting a second contact element 170*b*. The base 150 compresses to absorb regional differences in pressure at the die level because the contact elements 170 can move independently from one another in a direction transverse to the substrate 12. The second contact element 170*b*, for example, can have a displacement C relative to the first contact element 170*a* corresponding to a greater pressure at the second contact element 170*b*. The planarizing pad 140 accordingly provides the characteristics of a soft pad to mitigate edge effects on the substrate 12. The individual contact elements 170, however, do not conform to the local topography of the dies, and thus the hard contact elements 170 provide the characteristics of a hard planarizing pad to mitigate or prevent "doming" over the dies. Therefore, the embodiment of the planarizing pad 140 shown on FIG. 4 is expected to provide good global planarity without producing unacceptable levels of doming over the dies.

Figure 5:
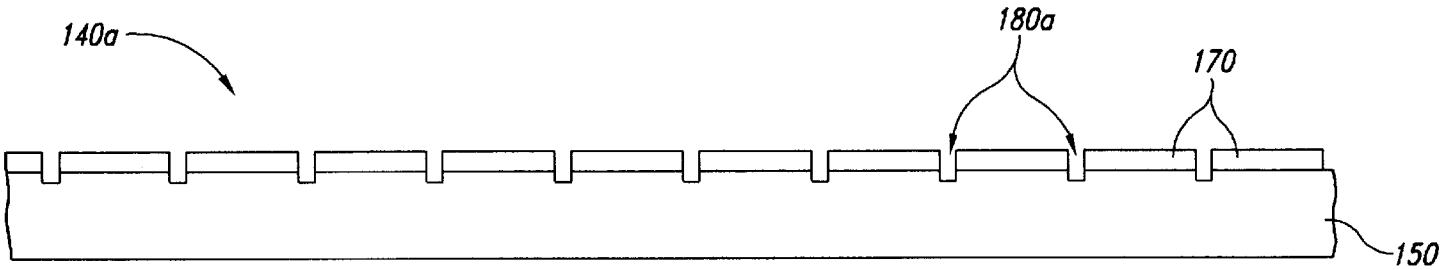
FIG. 5 is a partial cross-sectional view of a planarizing pad in accordance with another embodiment of the invention.
Figure 6:
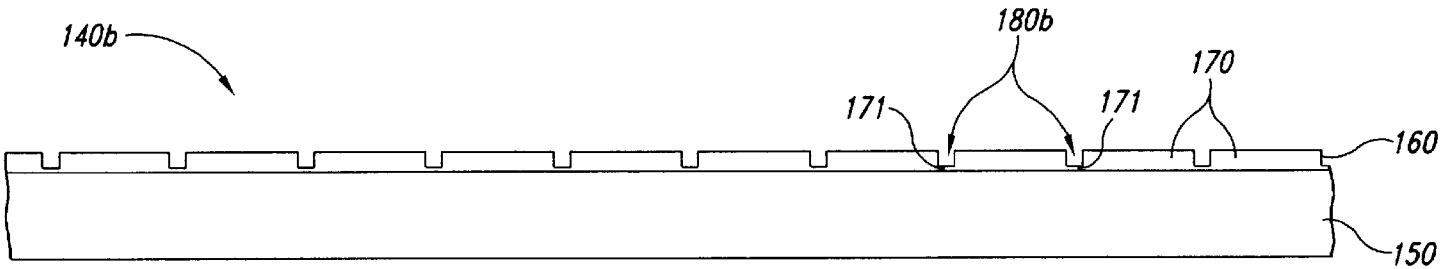
FIG. 6 is a partial cross-sectional view of a planarizing pad in accordance with yet another embodiment of the invention.
Figure 7:
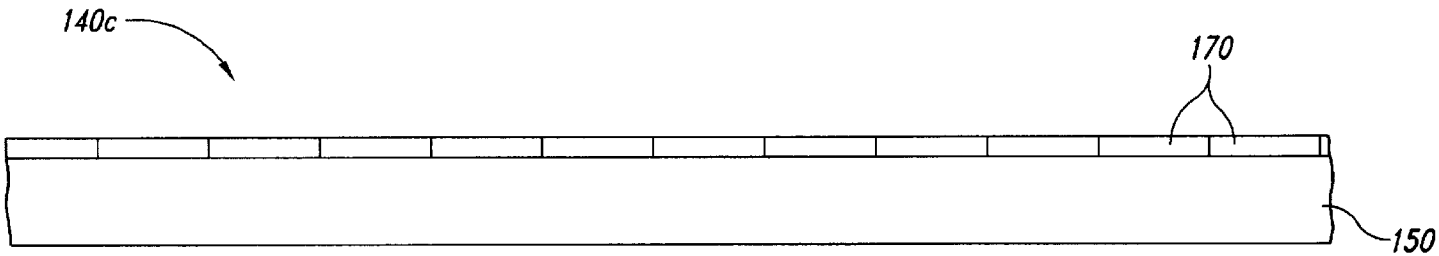
FIG. 7 is a partial cross-sectional view of a planarizing pad in accordance with still another embodiment of the invention.

FIGS. 5–7 are partial cross-sectional views of other planarizing pads in accordance with additional embodiments of the invention. FIG. 5 illustrates a planarizing pad 140*a* having a compressible base 150, separate plates defining the contact elements 170, and deep grooves 180*a* between the contact elements 170. The grooves 180*a* extend completely through the contact layer 160 to an intermediate elevation in the base 150.

FIG. 6 illustrates a planarizing pad 140*b* having a compressible base layer defining the base 150 and a hard contact layer 160 having a plurality of shallow channels 180*b* between the contact elements 170. The shallow channels 180*b* do not extend completely through the contact layer 160, and thus the contact layer 160 has thin, flexible sections 171 between the contact elements 170. In the embodiment shown in FIG. 6, the contact elements 170 are discrete raised sections or lands of an integral contact layer. The raised sections can move independently from one another in a direction transverse to the substrate assembly 12 because the thin sections 171 flex in response to differences in pressure across the pad 140*b*.

FIG. 7 shows a planarizing pad 140*c* having a compressible base 150 and a plurality of contact elements 170 attached to the base 150 so that the sides 178 of adjacent contact elements 170 abut one another. In the embodiment of the planarizing pad 140*c* shown in FIG. 7, the contact elements 170 can be separate plates that are individually attached to the base 150 by an adhesive. The contact elements 170 can accordingly be small tiles of a suitable hard material, such as a polycarbonate, resin or high density polymer. The embodiments of the planarizing pads 140*a*–140*c* shown in FIGS. 5–7 are expected to produce results similar to the planarizing pad 140 explained above with reference to FIGS. 2A–4.

Figure 8:
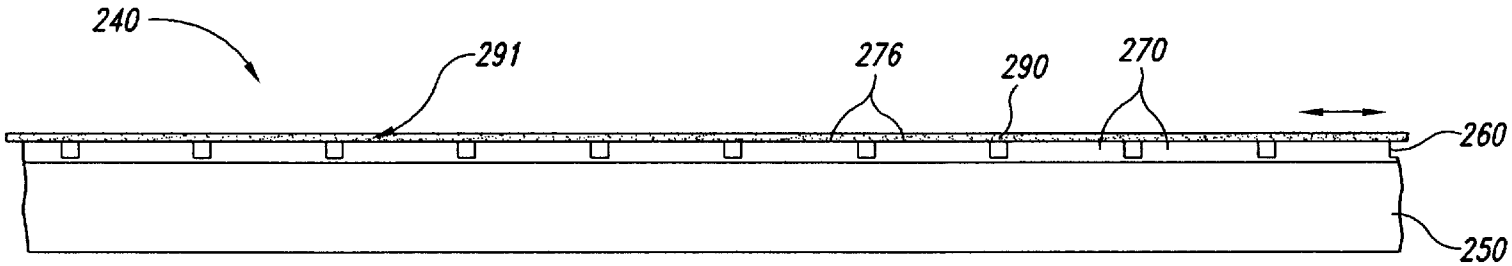
FIG. 8 is a partial cross-sectional view of a planarizing pad for a fixed-abrasive application in accordance with an embodiment of the invention.
Figure 9:
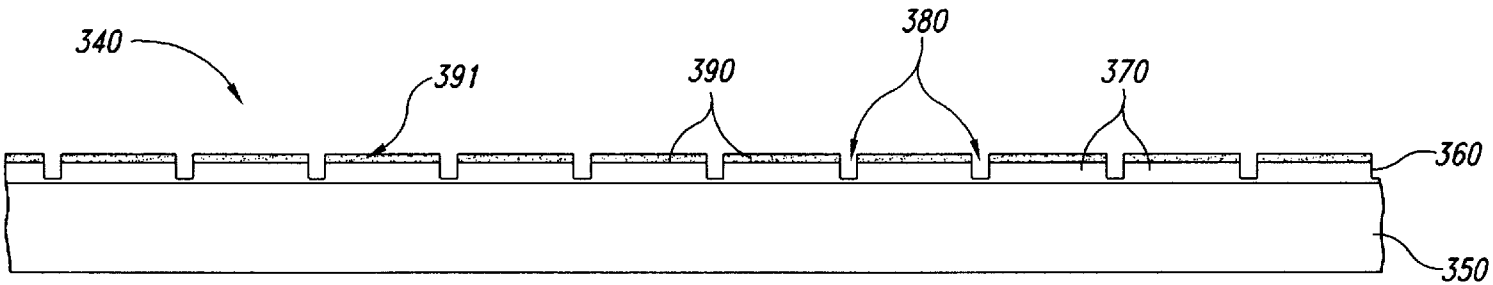
FIG. 9 is a partial cross-sectional view of a planarizing pad for a fixed-abrasive application in accordance with another embodiment of the invention.
Figure 10:
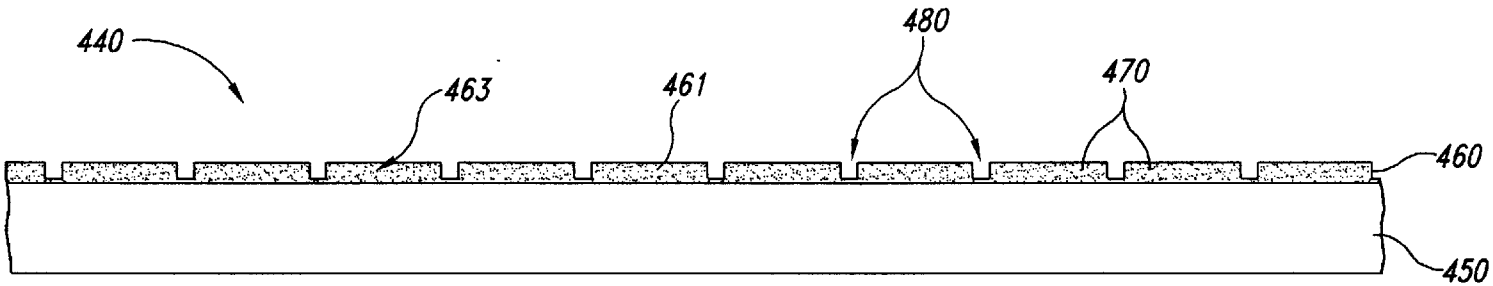
FIG. 10 is a partial cross-sectional view of a planarizing pad for a fixed-abrasive application in accordance with yet another embodiment of the invention.

FIGS. 8–10 are cross-sectional views illustrating embodiments of fixed-abrasive planarizing pads in accordance with additional embodiments of the invention. FIG. 8 illustrates a planarizing pad 240 having a compressible base 250 and a hard contact layer 260 on the base 250. The contact layer 260 has a plurality of hard contact elements 270 that are at least substantially incompressible. The base 250 can be the same as the base 150, and the elements 270 can be the same as the contact elements 170 of the planarizing pad 140*b* shown in FIG. 6. The planarizing pad 240 also includes a fixed-abrasive sheet 290 on the top surfaces 276 of the contact elements 270. The fixed-abrasive sheet 290 can be a thin, flexible sheet having a suspension medium and a plurality of abrasive particles 291 bonded to the suspension medium. Suitable abrasive sheets are manufactured by 3M Corporation of St. Paul, Minn. and disclosed in U.S. Pat. No. 5,692,950, which is incorporated herein by reference. In a web-format application, the base 250 is fixed to a table so that the base 250 and the contact elements 270 act as a stationary subpad. As explained in more detail, the fixed-abrasive sheet 290 shown in FIG. 8 can be coupled to a roller system to move the fixed abrasive sheet 290 across the contact elements 270. In other applications, the fixed-abrasive sheet 290 shown in FIG. 8 can be adhered to the contact elements 270 by a suitable adhesive.

FIG. 9 is a partial cross-sectional view of a fixed-abrasive planarizing pad 340 in accordance with another embodiment of the invention. In this embodiment, the planarizing pad 340 has a compressible base 350 and a hard contact layer 360 on the base 350. The base 350 and the contact layer 360 can be substantially the same as those described above with respect to the base 150 and the contact layer 160 of FIG. 6. The contact layer 360 accordingly has a plurality of raised sections 370 separated by channels or gaps 380. The planarizing pad 340 also has a plurality of abrasive contact elements 390 on the raised sections 370. The abrasive contact elements 390 can include a resin suspension medium and a plurality of abrasive particles 391 bonded to the suspension medium.

FIG. 10 is a partial cross-sectional view of a fixed-abrasive planarizing pad 440 in accordance with another embodiment of the invention. In this embodiment, the planarizing pad 440 has a compressible base 450 and a hard contact layer 460. The contact layer 460 can include a resin 461 and a plurality of abrasive particles 463 distributed in and/or on the resin 461. The contact layer 460 has a plurality of contact elements 470 that are separated by gaps 480. The gaps 480 can extend to an intermediate level in the hard layer 460, or the gaps 480 can extend completely through the hard layer 460. The fixed-abrasive planarizing pads 240, 340 and 440 shown in FIGS. 8–10 are suitable for fixed-abrasive applications where the abrasive particles are preferably fixed to the planarizing pad. Also, the channels or gaps between the contact elements or the raised sections can extend through the contact layer or the hard layer in a manner similar to the channels 180 shown in FIG. 5.

Figure 11:
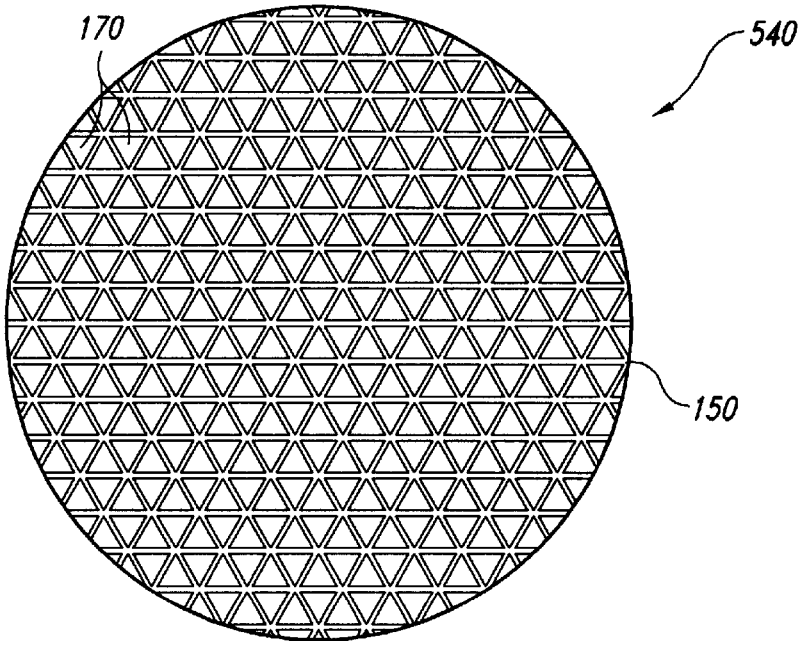
FIG. 11 is a top plan view of a planarizing pad in accordance with an embodiment of the invention.
Figure 12:
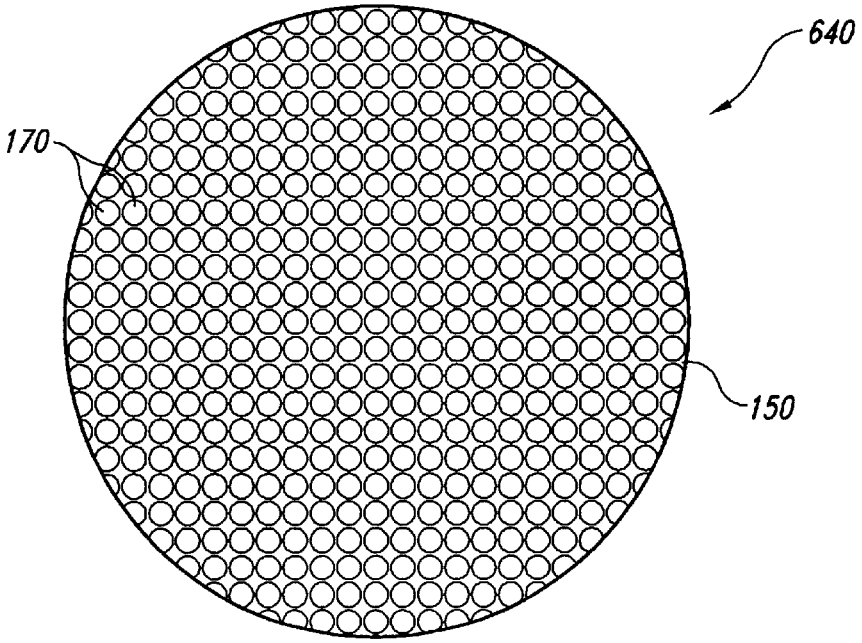
FIG. 12 is a top plan view of a planarizing pad in accordance with another embodiment of the invention.

FIGS. 11 and 12 are planform views of planarizing pads 540 and 640 in accordance with additional embodiments of the invention. Referring to FIG. 11, the planarizing pad 540 has a compressible base 150 and a plurality of triangular contact elements 170. FIG. 12 shows a planarizing pad 640 having a compressible base 150 and a plurality of circular contact elements 170. The contact elements for any of the pads shown in FIGS. 2A–10 can accordingly be rectilinear, triangular, circular, or any other suitable shape. The planarizing pads 540 and 640 shown in FIGS. 11 and 12 can be either nonabrasive or fixed-abrasive pads according to the various embodiments of planarizing pads explained above.

Figure 13:
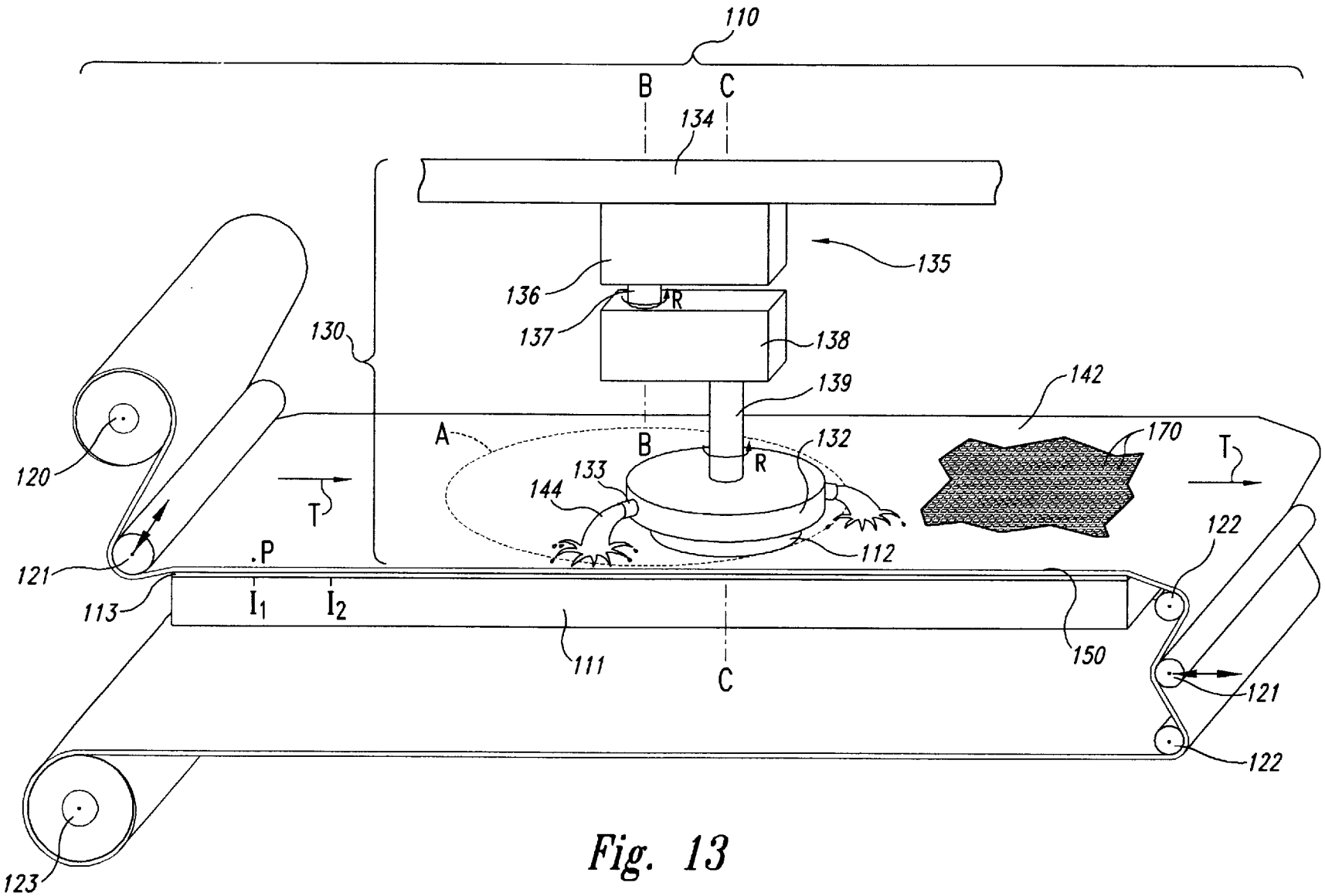
FIG. 13 is a partially schematic isometric view of a web-format planarizing machine and a planarizing pad in accordance with an embodiment of the invention.

FIG. 13 is an isometric view of a web-format planarizing machine 110 including a web-format embodiment of the planarizing pad 140 for planarizing a substrate 12. The planarizing machine 110 has a support table 114 with a top-panel 116 at a workstation where an operative portion (A) of the planarizing pad 140 is positioned. The top-panel 116 is generally a rigid plate to provide a flat, solid surface to which a particular section of the planarizing pad 140 may be secured during planarization.

The planarizing machine 110 also has a plurality of rollers to guide, position and hold the planarizing pad 140 over the top-panel 116. The rollers include a supply roller 120, idler rollers 121, guide rollers 122, and a take-up roller 123. The supply roller 120 carries an unused or pre-operative portion of the planarizing pad 140, and the take-up roller 123 carries a used or post-operative portion of the planarizing pad 140. Additionally, the left idler roller 121 and the upper guide roller 122 stretch the planarizing pad 140 over the top-panel 116 to hold the planarizing pad 140 stationary during operation. A motor (not shown) generally drives the take-up roller 123 to sequentially advance the planarizing pad 140 across the top-panel 116, and the motor can also drive the supply roller 120. Accordingly, clean pre-operative sections of the planarizing pad 140 may be quickly substituted for used sections to provide a consistent surface for planarizing and/or cleaning the substrate 112.

The web-format planarizing machine 110 also has a carrier assembly 130 that controls and protects the substrate 12 during planarization. The carrier assembly 130 generally has a substrate holder 132 to pick up, hold and release the substrate 12 at appropriate stages of the planarizing process. Several nozzles 133 attached to the substrate holder 132 dispense a planarizing: solution 144 onto the planarizing surface 142 of the planarizing pad 140. The carrier assembly 130 also generally has a support gantry 134 carrying a drive assembly 135 that can translate along the gantry 134. The drive assembly 135 generally has an actuator 136, a drive shaft 137 coupled to the actuator 136, and an arm 138 projecting from the drive shaft 137. The arm 138 carries the substrate holder 132 via a terminal shaft 139 such that the drive assembly 135 orbits the substrate holder 132 about an axis B—B (arrow $R_1$). The terminal shaft 139 may also rotate the substrate holder 132 about its central axis C—C (arrow $R_2$).

The planarizing pad 140 can have the compressible body 150 and a plurality of the contact elements 170 (only a few shown). The planarizing pad can instead have any of the structures described above with reference to FIGS. 5–12. In an embodiment in which the planarizing pad 240 shown in FIG. 8 has a detachable abrasive sheet 290, the base 250 is attached to the top panel 116 (FIG. 13) and only the abrasive sheet 290 is wrapped around the rollers 120 and 123. The base 250 and the raised features 270 accordingly remain in a fixed position and act as a sub-strata for the abrasive sheet.

To planarize the substrate 12 with the planarizing machine 110, the carrier assembly 130 presses the substrate 12 against the planarizing surface 142 of the planarizing pad 140 in the presence of the planarizing solution 144. The drive assembly 135 then translates the substrate 12 across the planarizing surface 142 by orbiting the substrate holder 132 about the axis B—B and/or rotating the substrate holder 132 about the axis C—C. As a result, the abrasive particles and/or the chemicals in the planarizing medium remove material from the surface of the substrate 112.

From the foregoing it will be appreciated that the specific embodiments of the invention described herein are for purposes of illustration to enable a person skilled in the art to make and use embodiments of the invention and to disclose the best known embodiments of the invention. As such, various modifications may be made to the foregoing embodiments of the invention without deviating from the spirit and scope of the invention. For example, the planarizing pads shown in FIGS. 2A–10 can have combinations of differently shaped contact elements that are configured in uniform, non-uniform or random patterns. Moreover, the planarizing pads can have a combination of both non-abrasive and abrasive contact elements. Accordingly, the invention is not limited except as by the appended claims.

What is claimed is:

1. A planarizing pad for mechanical or chemical-mechanical planarization of microelectronic substrate assemblies, comprising:

a base having a back side and a front side, the base having a first hardness; and a plurality of separate plates having a bottom surface attached to the front side of the base and top surface configured to contact a microelectronic substrate, each of the plates having a second hardness greater than the first hardness of the base.

2. The pad of claim 1 wherein the base comprises a foamed polyurethane sheet.

3. The pad of claim 1 wherein the base comprises a felt sheet.

4. The pad of claim 1 wherein the plates comprise polycarbonate panels.

5. The pad of claim 1 wherein the plates comprise polyester panels.

6. The pad of claim 1 wherein the plates comprise resin panels.

7. The pad of claim 1 wherein:

the base comprises a sheet having a hardness not greater than 60 Shore A and a compressibility not less than 10%; and the plates comprise panels having a hardness not less than 50 Shore D and a compressibility not greater than 5%.

8. The pad of claim 1 wherein:

the base comprises a sheet having a hardness not greater than 50 Shore A and a compressibility not less than 12%; and the plates comprise panels having a hardness not less than 55 Shore D and a compressibility not greater than 3%.

9. The pad of claim 1 wherein the top surface of each plate has a size of approximately 10–300% of a size of a die on a substrate planarized on the pad, and the top surface is flat.

10. The pad of claim 1 wherein the plates have a size of approximately 75–150% of a size of a die on a substrate planarized on the pad.

11. The pad of claim 1 wherein the plates have sides, and wherein at least one side of each plate abuts a side of an adjacent plate.

12. The pad of claim 1, further comprising a plurality of channels separating the plates from one another.

13. The pad of claim 1 wherein the plates comprise fixed-abrasive contact surfaces having a suspension medium and a plurality of abrasive particles distributed in the suspension medium.

14. The pad of claim 1, further comprising a fixed-abrasive sheet on the top surfaces of the plates.

15. A planarizing pad for mechanical or chemical-mechanical planarization of microelectronic substrate assemblies, comprising:

a compressible body having a back side and a front side, the body having a first compressibility; and a plurality of discrete contact elements having a second compressibility less than the first compressibility, each contact element having a bottom surface attached to the front side of the base, a top surface configured to contact a microelectronic substrate facing away from the base, and side surfaces facing adjacent contact elements.

16. The pad of claim 15 wherein the contact elements comprise separate plates that are spaced apart from one another by gaps.

17. The pad of claim 15 wherein the contact elements comprise separate plates that abut adjacent plates.

18. The pad of claim 15 wherein:

the compressible body comprises a compressible sheet defining a base; and the contact elements comprise separate plates that are spaced apart from one another by channels extending into the base.

19. The pad of claim 15 wherein:

the compressible body comprises a compressible sheet defining a base; and the contact elements comprise raised sections of a hard contact layer on the base, the raised sections being separated from one another by thin, flexible sections of the contact layer defining shallow channels between the raised sections.

20. The pad of claim 15 wherein the contact elements have a size of approximately 10–300% of a size of a die on a selected substrate.

21. The pad of claim 15 wherein the contact elements have a size of approximately 75–150% of a size of a die on a selected substrate.

22. The pad of claim 15 wherein:

the compressible body comprises a compressible sheet defining a base; and the contact elements comprise separate plates having a suspension medium and abrasive particles distributed in the suspension medium, the suspension medium being a hard contact layer on the base.

23. The pad of claim 15 wherein:

the compressible body comprises a compressible sheet defining a base; and the contact elements comprise raised sections of a hard contact layer comprising a suspension medium and abrasive particles distributed in the suspension medium, the raised sections being separated from one another by thin, flexible sections of the contact layer defining shallow channels between the raised sections.

24. The pad of claim 15 wherein:

the compressible body comprises a compressible sheet defining a base; and the contact elements comprise raised sections of a hard layer on the base and a fixed-abrasive sheet on the raised sections, the raised sections being separated from one another by thin, flexible sections of the hard layer, and the fixed-abrasive sheet being attached to the raised sections.

25. The pad of claim 15 wherein:

the compressible body comprises a compressible sheet defining a base; and the contact elements comprise raised sections of a hard layer on the base and a fixed-abrasive sheet on the raised sections, the raised sections being separated from one another by thin, flexible sections of the hard layer, and the fixed-abrasive sheet being slidably positioned on the raised sections.

26. The pad of claim 15 wherein:

the compressible body comprises a compressible sheet defining a base; and the contact elements comprise separate plates having a hard layer on the base and a fixed-abrasive layer on the hard layer.

27. A planarizing pad for mechanical or chemical-mechanical planarization of microelectronic substrate assemblies, comprising:

a base having a back side configured to be coupled to a table of a planarizing machine and a front side, the base having a first hardness; and a plurality of contact elements attached to the front side of the base, the contact elements having a second hardness greater than the first hardness of the base, and the contact elements being independently movable with respect to each other in a direction transverse to the backside of the base.

28. The pad of claim 27 wherein the contact elements comprise separate plates that are spaced apart from one another by gaps.

29. The pad of claim 27 wherein the contact elements comprise separate plates that abut adjacent plates.

30. The pad of claim 27 wherein:

the base comprises a compressible body having a compressible sheet; and the contact elements comprise raised sections of a hard contact layer on the base, the raised sections being separated from one another by thin, flexible sections of the contact layer defining shallow channels between the raised sections.

31. The pad of claim 27 wherein the contact elements have a size of approximately 10–300% of a size of a die on a selected substrate.

32. The pad of claim 21 wherein the contact elements have a size of approximately 75–150% of a size of a die on a selected substrate.

33. The pad of claim 27 wherein:

the base comprises a compressible body having a compressible sheet; and the contact elements comprise separate plates having a suspension medium and abrasive particles distributed in the suspension medium, the suspension medium being a hard contact layer on the base.

34. The pad of claim 27 wherein:

the base comprises a compressible body having a compressible sheet; and the contact elements comprise raised sections of a hard contact layer comprising a suspension medium and abrasive particles distributed in the suspension medium, the raised sections being separated from one another by thin, flexible sections of the contact layer defining shallow channels between the raised sections.

35. The pad of claim 27 wherein:

the base comprises a compressible body having a compressible sheet; and the contact elements comprise raised sections of a hard layer on the base and a fixed-abrasive sheet on the raised sections, the raised sections being separated from one another by thin, flexible sections of the hard layer, and the fixed-abrasive sheet being attached to the raised sections.

36. The pad of claim 27 wherein:

the base comprise a compressible body having a compressible sheet; and the contact elements comprise raised sections of a hard layer on the base and a fixed-abrasive sheet on the raised sections, the raised sections being separated from one another by thin, flexible sections of the hard layer, and the fixed-abrasive sheet being slidably positioned on the raised sections.

37. A planarizing machine for mechanical or chemical-mechanical planarization of microelectronic-device substrates, comprising:

a table having a support surface;

a planarizing pad coupled to the support surface of the table, the pad comprising a base and a plurality of separate plates, the base having a back side facing the support surface, a front side facing away from the support surface, and a first hardness, and the separate plates having a bottom surface attached to the front side of the base, a top surface facing away from the base, and a second hardness greater than the first hardness; and a substrate carrier assembly having a drive system and a carrier head coupled to the drive system, the carrier head being configured to hold a substrate and the drive system being configured to move the carrier head to engage the substrate with the plates of the pad, wherein at least one of the carrier head and the table is movable relative to the other to rub the substrate against the plates of the pad.

38. The planarizing machine of claim 37 wherein the base comprises a foamed polyurethane sheet.

39. The planarizing machine of claim 37 wherein the base comprises a felt sheet.

40. The planarizing machine of claim 37 wherein the plates include a polycarbonate material.

41. The planarizing machine of claim 37 wherein the plates include a polyester material.

42. The planarizing machine of claim 37 wherein the plates include a resin material.

43. The planarizing machine of claim 37 wherein:

the base has a hardness not greater than 60 Shore A and a compressibility not less than 10%; and the plates have a hardness not less than 50 Shore D and a compressibility not greater than 5%.

44. The planarizing machine of claim 37 wherein:

the base has a hardness not greater than 50 Shore A and a compressibility not less than 12%; and the plates have a hardness not less than 55 Shore D and a compressibility not greater than 3%.

45. The planarizing machine of claim 37 wherein the plates have a size of approximately 10–300% of a size of a die on a selected substrate.

46. The planarizing machine of claim 37 wherein the plates have a size of approximately 75–150% of a size of a die on a selected substrate.

47. The planarizing machine of claim 37 wherein the plates have sides, and wherein at least one side of each plate abuts a side of an adjacent plate.

48. The planarizing machine of claim 37, further comprising a plurality of channels separating the plates from one another.

49. The planarizing machine of claim 37 wherein the plates comprise fixed-abrasive plates having a suspension medium and a plurality of abrasive particles distributed in the suspension medium.

50. The planarizing machine of claim 37, further comprising a fixed-abrasive sheet on the top surfaces of the plates.

51. A planarizing machine for mechanical or chemical-mechanical planarization of microelectronic-device substrates, comprising:

a table having a support surface;

a planarizing pad coupled to the support surface of the table, the pad comprising a compressible body and a plurality of discrete contact elements, the compressible body having a back side facing the support surface, a front side facing away from the support surface, and a first compressibility, and the discrete contact elements having a bottom surface attached to the front side of the base, a top surface facing away from the base, and a second compressibility less than the first compressibility; and a substrate carrier assembly having a drive system and a carrier head coupled to the drive system, the carrier head being configured to hold a substrate and the drive system being configured to move the carrier head to engage the substrate with the contact elements of the pad, wherein at least one of the carrier head and the table is movable relative to the other to rub the substrate against the plates of the pad.

52. The planarizing machine of claim 51 wherein the contact elements comprise separate plates that are spaced apart from one another by gaps.

53. The planarizing machine of claim 51 wherein the contact elements comprise individual plates that abut adjacent plates.

54. The planarizing machine of claim 51 wherein:

the compressible body comprises a compressible base; and the contact elements comprise separate plates on the base that are spaced apart from one another by channels extending into the base.

55. The planarizing machine of claim 51 wherein:

the compressible body comprises a compressible base; and the contact elements comprise raised sections of a hard contact layer on the base, the raised sections being separated from one another by thin, flexible sections of the contact layer between the raised sections.

56. The planarizing machine of claim 51 wherein the contact elements have a size of approximately 10–300% of a size of a die on a selected substrate.

57. The planarizing machine of claim 51 wherein the contact elements have a size of approximately 75–150% of a size of a die on a selected substrate.

58. The planarizing machine of claim 51 wherein:

the compressible body comprises a compressible sheet base; and the contact elements comprise separate plates having a suspension medium and abrasive particles distributed in the suspension medium, the suspension medium.

59. The planarizing machine of claim 51 wherein:

the compressible body comprises a compressible base; and the contact elements comprise raised sections of a hard contact layer comprising a suspension medium and abrasive particles distributed in the suspension medium, the raised sections being separated from one another by thin, flexible sections of the contact layer between the raised sections.

60. The planarizing machine of claim 51 wherein:

the compressible body comprises a compressible base; and the contact elements comprise raised sections of a hard layer on the base and a fixed-abrasive sheet on the raised sections, the raised sections being separated from one another by thin, flexible sections of the hard layer, and the fixed-abrasive sheet being attached to the raised sections.

61. The planarizing machine of claim 51 wherein:

the compressible body comprises a compressible sheet defining a base; and the contact elements comprise raised sections of a hard layer on the base and a fixed-abrasive sheet on the raised sections, the raised sections being separated from one another by thin, flexible sections of the hard layer, and the fixed-abrasive sheet being slidably positioned on the raised sections.

62. The planarizing machine of claim 51 wherein:

the compressible body comprises a compressible base; and the contact elements comprise separate plates having a hard layer on the base and a fixed-abrasive layer on the hard layer.

63. A planarizing machine for mechanical or chemical-mechanical planarization of microelectronic-device substrates, comprising:

a table having a support surface;

a planarizing pad coupled to the support surface of the table, the pad comprising a base and a plurality of contact elements, the base having a back side facing the support surface, a front side facing away from the support surface, and a first hardness, and the contact elements having a second hardness greater than the first hardness and the contact elements being independently moveable with respect to each other in a direction transverse to the backside of the base; and a substrate carrier assembly having a drive system and a carrier head coupled to the drive system, the carrier head being configured to hold a substrate and the drive system being configured to move the carrier head to engage the substrate with the contact elements of the pad, wherein at least one of the carrier head and the table is movable relative to the other to rub the substrate against the plates of the pad.

64. The planarizing machine of claim 63 wherein the contact elements comprise separate plates that are spaced apart from one another by gaps.

65. The planarizing machine of claim 63 wherein the contact elements comprise separate plates that abut adjacent plates.

66. The planarizing machine of claim 63 wherein:

the base comprises a compressible body having a compressible sheet; and the contact elements comprise raised sections of a hard contact layer on the base, the raised sections being separated from one another by thin, flexible sections of the contact layer defining shallow channels between the raised sections.

67. The planarizing machine of claim 63 wherein the contact elements have a size of approximately 10–300% of a size of a die on a selected substrate.

68. The planarizing machine of claim 63 wherein the contact elements have a size of approximately 75–150% of a size of a die on a selected substrate.

69. The planarizing machine of claim 63 wherein:

the base comprises a compressible body having a compressible sheet; and the contact elements comprise separate plates having a suspension medium and abrasive particles distributed in the suspension medium, the suspension medium being a hard contact layer on the base.

70. The planarizing machine of claim 63 wherein:

the base comprises a compressible body having a compressible sheet; and the contact elements comprise raised sections of a hard contact layer comprising a suspension medium and abrasive particles distributed in the suspension medium, the raised sections being separated from one another by thin, flexible sections of the contact layer defining shallow channels between the raised sections.

71. The planarizing machine of claim 63 wherein:

the base comprises a compressible body having a compressible sheet; and the contact elements comprise raised sections of a hard layer on the base and a fixed-abrasive sheet on the raised sections, the raised sections being separated from one another by thin, flexible sections of the hard layer, and the fixed-abrasive sheet being attached to the raised sections.

72. The planarizing machine of claim 63 wherein:

the base comprises a compressible body having a compressible sheet; and the contact elements comprise raised sections of a hard layer on the base and a fixed-abrasive sheet on the raised sections, the raised sections being separated from one another by thin, flexible sections of the hard layer, and the fixed-abrasive sheet being slidably positioned on the raised sections.

73. A method of planarizing a microelectronic-device substrate, comprising:

engaging the substrate with a plurality of separate plates on a compressible base, the plates being independently moveable with respect to each other in a direction transverse to the substrate; and moving at least one of the substrate and the plates to rub the substrate against the contact plates in a planarizing plane.

74. The method of claim 73 wherein engaging the substrate with the plurality of plates comprises compressing a first portion of the base more than a second portion of the base.

75. The method of claim 73, further comprising:

providing a base having a hardness not greater than 60 Shore A and a compressibility not less than 10%; and providing plates having a hardness not less than 50 Shore D and compressibility not greater than 5%.

76. The method of claim 73, further comprising:

providing a base having a hardness not greater than 50 Shore A and a compressibility not less than 12%; and providing plates having a hardness not less than 55 Shore D and compressibility not greater than 3%.

77. The method of claim 73, further comprising providing plates having a size of approximately 10–300% of a size of a die on a selected substrate.

78. A method of planarizing a microelectronic-device substrate, comprising:

engaging the substrate with a plurality of discrete contact elements on a compressible body, the compressible body having a first compressibility and the contact elements having a second compressibility less than the first compressibility, the contact elements being independently moveable with respect to each other corresponding to compression of the compressible body; and moving at least one of the substrate and the contact elements to rub the substrate against the contact elements in a planarizing plane.

79. The method of claim 78 wherein engaging the substrate with the plurality of contact elements comprises. compressing a first portion of the body more than a second portion of the body.

80. The method of claim 78, further comprising:

providing a compressible body having a hardness not greater than 60 Shore A and a compressibility not less than 10%; and providing contact elements having a hardness not less than 50 Shore D and compressibility not greater than 5%.

81. The method of claim 78, further comprising:

providing a compressible body having a hardness not greater than 50 Shore A and a compressibility not less than 12%; and providing contact elements having a hardness not less than 55 Shore D and compressibility not greater than 3%.

82. The method of claim 78, further comprising providing contact elements having a size of approximately 10–300% of a size of a die on a selected substrate.

83. A method of manufacturing a planarizing pad for planarizing a microelectronic-device substrate, comprising:

fabricating a base having a first hardness;

forming a plurality of contact elements on the base, the contact elements having a flat top surface and a second hardness greater than the first hardness, and the contact elements being moveable with respect each other according to compression of the base.

84. The method of claim 83 wherein forming the contact elements comprises:

covering the base with a contact layer having the second hardness; and constructing channels in the contact layer.

85. The method of claim 84 wherein constructing the channels comprises etching through at least a portion of the contact layer.

86. The method of claim 84 wherein constructing the channels comprises cutting through at least a portion of the contact layer with a tool.

87. A planarizing pad for mechanical or chemical-mechanical planarization of microelectronic substrate assemblies, comprising:

a base having a back side and a front side, the base comprising a sheet having a hardness not greater than 50 Shore A and a compressibility not less than 12%; and a plurality of separate plates having a bottom surface attached to the front side of the base and top surface configured to contact a microelectronic substrate, the plates comprising panels having a hardness not less than 55 Shore D and a compressibility not greater than 3%.

88. A planarizing pad for mechanical or chemical-mechanical planarization of microelectronic substrate assemblies, comprising:

a base having a back side and a front side, the base having a first hardness; and a plurality of separate plates having a bottom surface attached to the front side of the base and top surface configured to contact a microelectronic substrate, the plates having a second hardness greater than the first hardness of the base, the top surface of each plate having a size of approximately 10–300% of a size of a die on a substrate planarized on the pad, and the top surface is flat.

89. A planarizing pad for mechanical or chemical-mechanical planarization of microelectronic substrate assemblies, comprising:

a base having a back side and a front side, the base having a first hardness; and a plurality of separate plates having a bottom surface attached to the front side of the base and top surface configured to contact a microelectronic substrate, the plates having a second hardness greater than the first hardness of the base, the plates having a size of approximately 75–150% of a size of a die on a substrate planarized on the pad.

90. A planarizing pad for mechanical or chemical-mechanical planarization of microelectronic substrate assemblies, comprising:

a base having a back side and a front side, the base having a first hardness; and a plurality of separate plates having a bottom surface attached to the front side of the base and top surface configured to contact a microelectronic substrate, the plates having a second hardness greater than the first hardness of the base, the plates comprising fixed-abrasive contact surfaces having a suspension medium and a plurality of abrasive particles distributed in the suspension medium.

91. A planarizing pad for mechanical or chemical-mechanical planarization of microelectronic substrate assemblies, comprising:

a base having a back side and a front side, the base having a first hardness;

a plurality of separate plates having a bottom surface attached to the front side of the base and top surface configured to contact a microelectronic substrate, the plates having a second hardness greater than the first hardness of the base; and a fixed-abrasive sheet on the top surfaces of the plates.

* * * * *

UNITED STATES PATENT AND TRADEMARK OFFICE

CERTIFICATE OF CORRECTION

PATENT NO. : 6,498,101 B1 
DATED : December 24, 2002
INVENTOR(S) : Wang

It is certified that error appears in the above-identified patent and that said Letters Patent is hereby corrected as shown below:

Column 1,
Line 40, "defame" should be -- define --;

Column 4,
Line 35, "defame" should be -- define --;

Column 11,
Line 8, "comprise" should be -- comprises --;

Signed and Sealed this

Nineteenth Day of August, 2003

JAMES E. ROGAN
*Director of the United States Patent and Trademark Office*